US006450501B1

(12) United States Patent
Yiu

(10) Patent No.: US 6,450,501 B1
(45) Date of Patent: Sep. 17, 2002

(54) DARTBOARD

(76) Inventor: Chih-Hao Yiu, 7-1 Floor, No. 30, Lin Sen Rd., Taichung City (TW)

( * ) Notice: Subject to any disclaimer, the term of this patent is extended or adjusted under 35 U.S.C. 154(b) by 0 days.

(21) Appl. No.: 09/665,609

(22) Filed: Sep. 20, 2000

(51) Int. Cl.[7] ..... F41J 5/052
(52) U.S. Cl. ..... 273/376
(58) Field of Search ..... 273/371, 374, 273/375, 376, 403, 408

(56) References Cited

U.S. PATENT DOCUMENTS 5,209,491 A * 5/1993 Dodge ..... 273/371
5,718,433 A * 2/1998 Lu et al. ..... 273/374
5,788,244 A * 8/1998 Hui et al. ..... 273/374
5,848,792 A * 12/1998 Brejcha ..... 273/376
6,047,968 A * 4/2000 Lu et al. ..... 273/371
6,116,607 A * 9/2000 Cho ..... 273/371

* cited by examiner

*Primary Examiner*—Mark S. Graham
(74) *Attorney, Agent, or Firm*—Charles E. Baxley

(57) ABSTRACT

A dartboard includes a frame with a backing connected thereto and a plurality of target parts are movably engaged with the frame. An electric detecting device is connected between the target parts and the backing. A plurality of noise absorbing members are connected between the target parts. The noise absorbing members are made of elastic viscous gel or silicon so that the target parts are moved without noise.

4 Claims, 4 Drawing Sheets

DARTBOARD

FIELD OF THE INVENTION

The present invention relates to a dartboard which includes a plurality of target parts separated by noise absorbing members so that the target parts move silently when hit by darts.

A conventional dartboard is shown in FIG. 4 and generally includes a frame 500 having a plurality of ribs 50 so that target parts 51 are engaged with the frame 500 and separated by the ribs 50. A backing 53 is connected to the frame and an electric detecting member 52 is located between the target parts 51 and the backing 53. When a dart hits the target part 51, the target part 51 is moved toward the backing 53 to press the electric detecting member 52 so that scores are displayed on a display device (not shown). It is great to enjoy the sound when the tip of the dart penetrate the target part 51. Because each target part 51 is arranged to be moved when hit by darts so that there is a gap defined between the ribs 50 and the target parts 51. However, when one of the target part 51 is hit, the rest of the target parts 51 in the dartboard shake and cause noise.

The present invention intends to provide a dartboard wherein noise absorbing members are connected between the target parts so that the target parts are moved without noise.

SUMMARY OF THE INVENTION

In accordance with one aspect of the present invention, there is provided a dartboard and comprising a frame having a plurality of target parts movably engaged with the frame and a backing connected to the frame. An electric detecting device is connected between the target parts and the backing. A plurality of noise absorbing members are connected between the target parts so that the target parts will not shake and move silently.

The primary object of the present invention is to provide a dartboard that produces no noise when darts hit on the dartboard.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
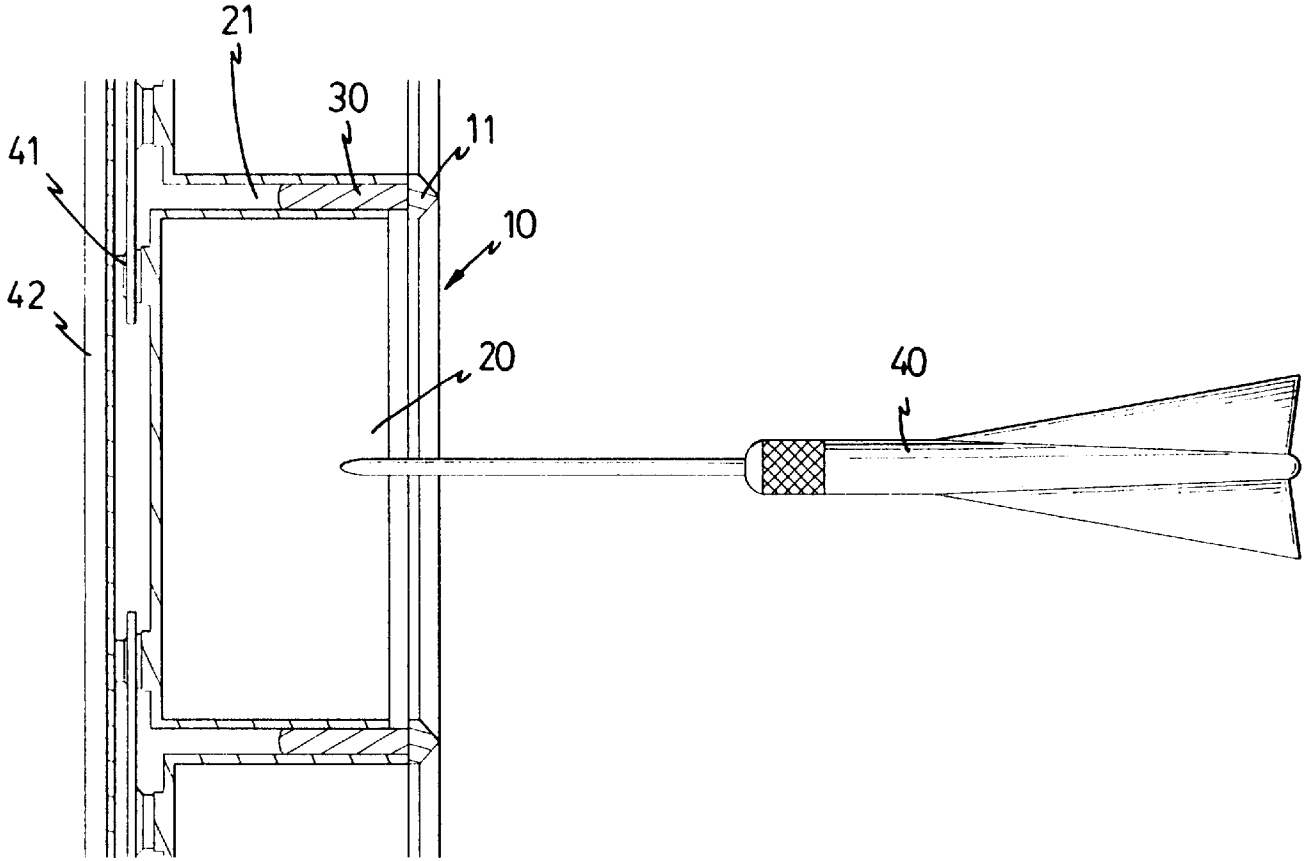
FIG. 1 is a side elevational view, partly in section, of a dartboard of the present invention and a dart hit on the dartboard.

Referring to FIG. 1, the dartboard of the present invention comprises a frame 10 having a plurality of ribs 11 extending from a front portion thereof so as to define several partitions and a plurality of target parts 20 are respectively and movably received in the partitions. A backing 42 is connected to a rear portion of the frame 10 and an electric detecting device 41 is connected between the target parts 20 and the backing 42. There are a gap 21 defined between any two adjacent target parts 20 and each gap 21 has a noise absorbing member 30 received therein. Each of the noise absorbing members 30 are connected between the adjacent target parts 20. When the target part 20 is hit by a dart 40, the target part 20 is moved toward the backing 42 to compress the electric detecting device 41. The noise absorbing member 30 absorbs the shakes of the target part 20 so that the target part 20 moves silently. Besides, when the dart 40 hits the dartboard, the rest of the target parts 20 are held by the noise absorbing members 30 so that they will not hit the frame 10 so that no noise is produced.

Figure 2:
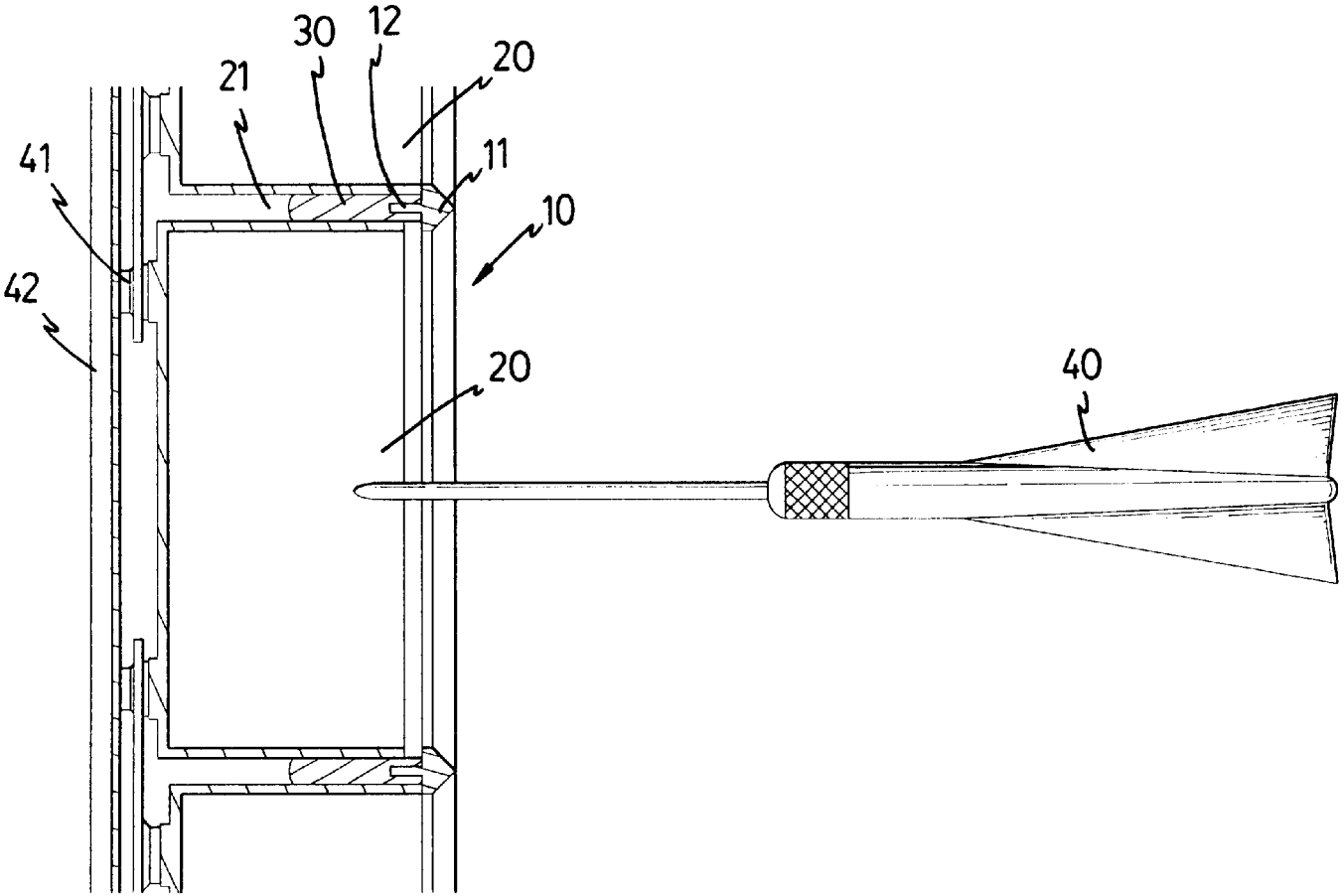
FIG. 2 is a first embodiment of the dartboard of the present invention.

FIG. 2 shows another embodiment of the dartboard wherein each of the ribs 11 has a shank 12 extends between the adjacent target parts 20 and is located in the gap 21. Each of the shanks 12 is wrapped by the noise absorbing member 30.

Figure 3:
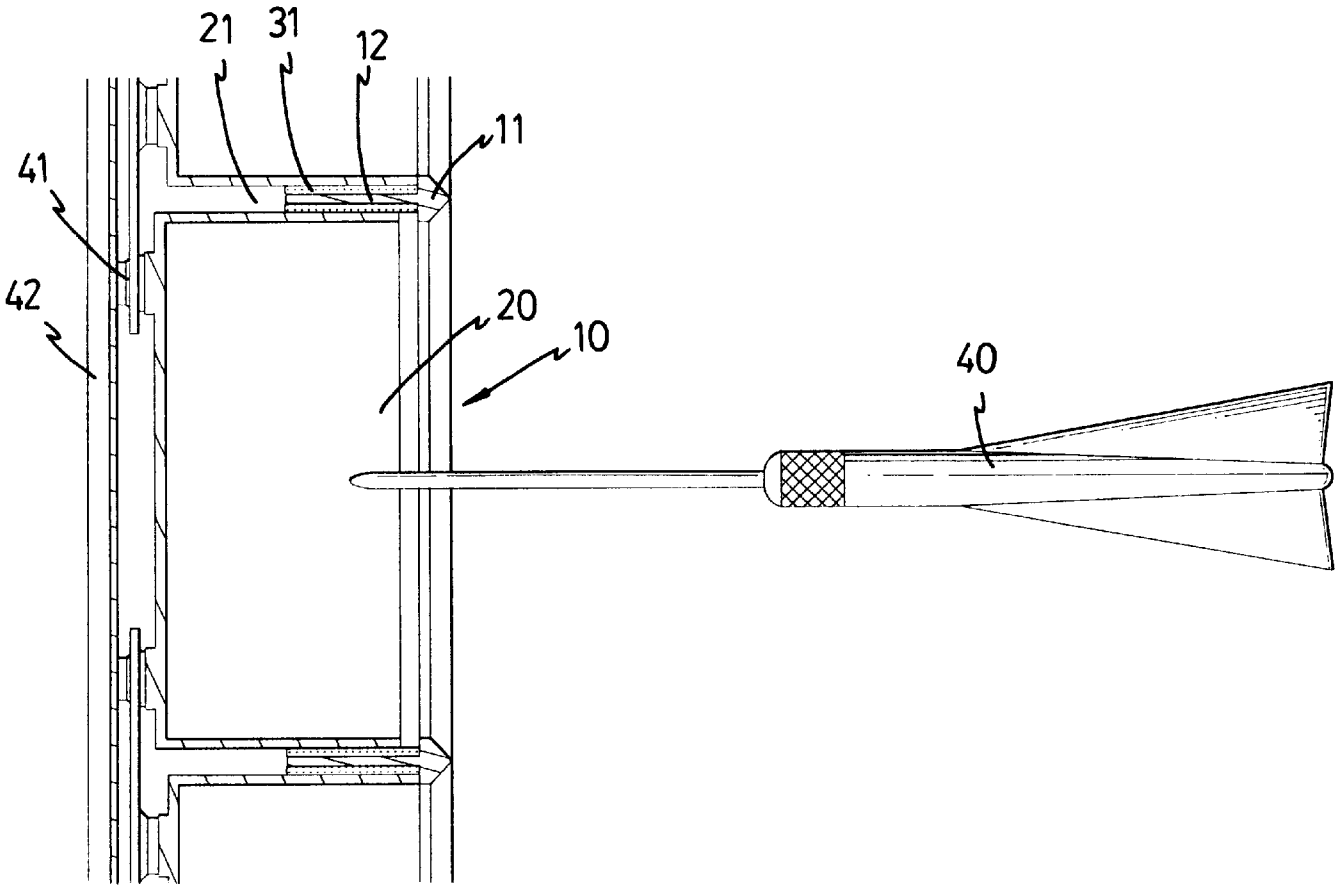
FIG. 3 is a second embodiment of the dartboard of the present invention.
Figure 4:
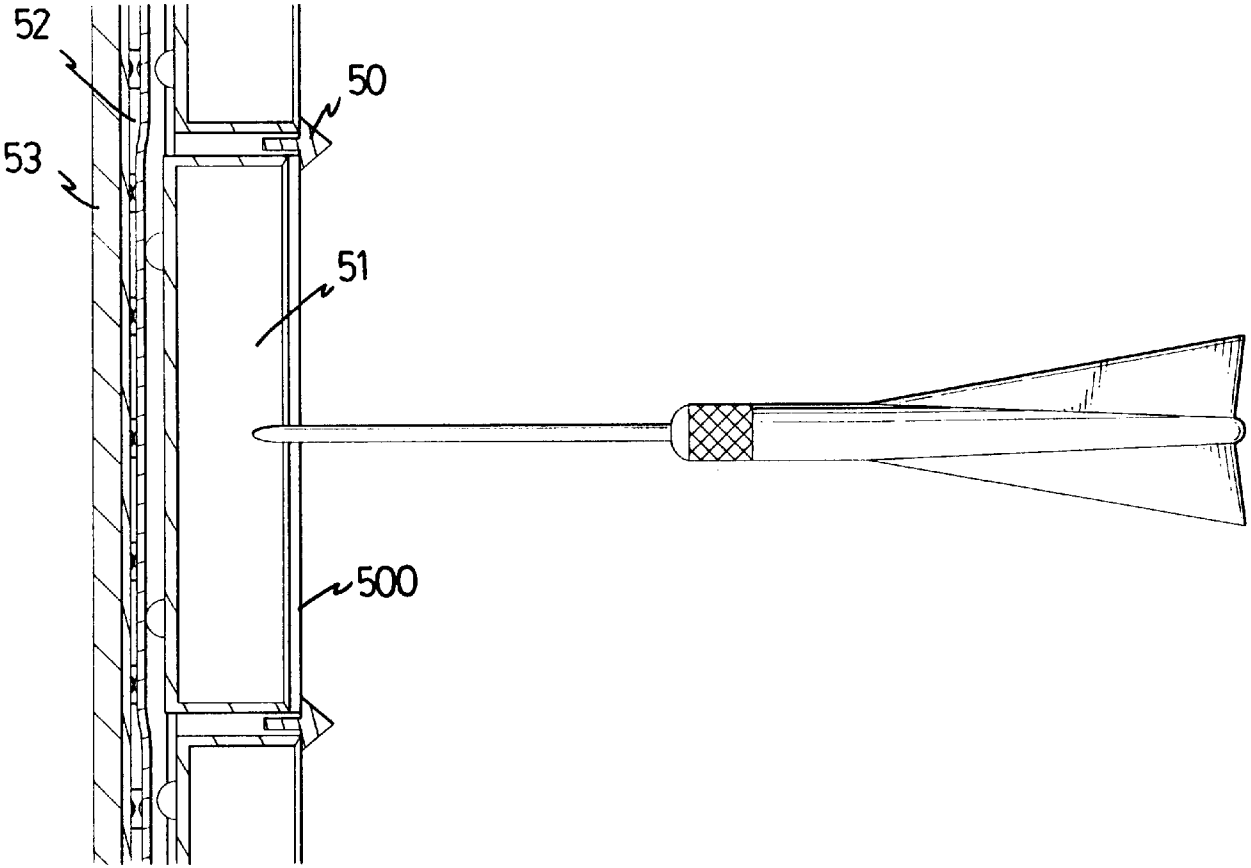
FIG. 4 PRIOR ART
FIG. 4 is a side elevational view, partly in section, of a conventional dartboard and a dart hit on the dartboard.

FIG. 3 shows yet another embodiment of the dartboard wherein the noise absorbing member 31 includes a plurality of layers and wrap around the shank 12 of each rib 11. The noise absorbing member 30/31 can be made of silicon which is elastic and has low friction efficient so that the target part 20 can be moved along the noise absorbing member 30 smoothly and silently. Therefore, the player can clearly here the sound of the penetration of the dart 40 into the target part 20. The noise absorbing member 30/31 can also be made of elastic and viscous gel which is adhered to the target part 20 and when the target part 20 is hit by the dart 40, the noise absorbing member 30/31 is deformed together with the movement of the target part 20.

While we have shown and described various embodiments in accordance with the present invention, it should be clear to those skilled in the art that further embodiments may be made without departing from the scope and spirit of the present invention.

What is claimed is:

1. A dartboard comprising:

a frame having a backing connected thereto and a plurality of target parts movably engaged with said frame, an electric detecting device connected between the target parts and said backing;

a plurality of ribs located between said target parts, and a plurality of noise absorbing members connected between said target parts and each of said ribs wrapped by a said noise absorbing member.

2. The dartboard as claimed in claim 1 wherein said noise absorbing member is made of silicon.

3. The dartboard as claimed in claim 1 wherein said noise absorbing member includes a plurality of layers.

4. The dartboard as claimed in claim 1 wherein said noise absorbing member is made of elastic and viscous gel.

* * * * *